US009079323B2

(12) United States Patent
Hauser et al.

(10) Patent No.: US 9,079,323 B2
(45) Date of Patent: Jul. 14, 2015

(54) SLICING DEVICE

(75) Inventors: Lawrence M. Hauser, Auburn, WA (US); Joanna Clark, Tacoma, WA (US)

(73) Assignee: Progressive International Corporation, Kent, WA (US)

( * ) Notice: Subject to any disclaimer, the term of this patent is extended or adjusted under 35 U.S.C. 154(b) by 385 days.

(21) Appl. No.: 13/365,609

(22) Filed: Feb. 3, 2012

(65) Prior Publication Data

US 2012/0131800 A1 May 31, 2012

Related U.S. Application Data

(63) Continuation-in-part of application No. 13/283,887, filed on Oct. 28, 2011, now Pat. No. 8,726,521.

(60) Provisional application No. 61/407,761, filed on Oct. 28, 2010.

(51) Int. Cl.

| | |
|---|---|
| ***B26B 3/00*** | (2006.01) |
| ***B26D 1/30*** | (2006.01) |
| ***B26D 3/24*** | (2006.01) |
| ***B26D 3/26*** | (2006.01) |
| *B26D 7/06* | (2006.01) |

(52) U.S. Cl.

CPC .. *B26D 1/30* (2013.01); *B26D 3/24* (2013.01); *B26D 3/26* (2013.01); *B26D 7/0608* (2013.01)

(58) Field of Classification Search

USPC ..... 30/302, 114, 117; 83/932; D7/673; 99/537, 538

See application file for complete search history.

(56) References Cited

U.S. PATENT DOCUMENTS

| | | | | | |
|---|---|---|---|---|---|
| 52,740 | A | | 2/1866 | Onderdonk | |
| 3,116,770 | A | | 1/1964 | Tanuma | |
| 4,095,339 | A | * | 6/1978 | Turner | 30/114 |
| 4,852,256 | A | * | 8/1989 | Schoettler | 30/114 |
| 5,337,480 | A | * | 8/1994 | Codikow | 30/114 |
| 5,749,145 | A | * | 5/1998 | Baukloh | 30/114 |
| D464,851 | S | * | 10/2002 | Dorion | D7/673 |
| D535,164 | S | | 1/2007 | St. Germain et al. | |
| D573,418 | S | * | 7/2008 | Ho | D7/673 |
| D576,454 | S | * | 9/2008 | Repac | D7/693 |
| D591,115 | S | * | 4/2009 | Repac | D7/693 |
| 8,046,921 | B2 | * | 11/2011 | Mastroianni | 30/114 |
| 8,286,355 | B2 | * | 10/2012 | Aby-Eva et al. | 30/114 |

FOREIGN PATENT DOCUMENTS

| | | |
|---|---|---|
| DE | 102007042660 | 11/2009 |
| GB | 2312613 | 11/1997 |

* cited by examiner

*Primary Examiner* — Omar Flores Sanchez

(74) *Attorney, Agent, or Firm* — Lowe Graham Jones PLLC

(57) ABSTRACT

A slicing device for cutting fruits or vegetables into wedges, cubes, or other desired shapes includes a slicing frame and a pusher, in which the frame includes a grid of internal cutting blades. The pusher is configured to be used to push at least partially sliced food items through the gaps between cutting blades. In some versions, the pusher is pivotally attached to the slicer and includes a removable container.

10 Claims, 9 Drawing Sheets

SLICING DEVICE

PRIORITY CLAIM

This application is a continuation in part of U.S. application Ser. No. 13/283,887 filed Oct. 28, 2011, which claims priority to provisional application Ser. No. 61/407,761 filed Oct. 28, 2010.

FIELD OF THE INVENTION

This application relates to slicing devices, particularly including devices for slicing fruits and vegetables.

BACKGROUND OF THE INVENTION

Devices for cutting apples into sections have been available for many years. In a typical device, several radial blades are supported by a central hub blade and an outer frame. As the device is pushed downward over an apple, the central hub blade cuts the core into a central cylinder while the radial blades divide the remaining apple into several wedge-shaped sections.

Unfortunately, the current devices can be difficult to use because they do not readily push all the way through an apple or other food item. The skin of an apple, for example, may provide resistance against a complete cut. This leads to users pushing against the final bit of apple with their fingers, risking a cut or injury as the fingers come into contact with the blade.

Prior art devices for use in slicing apples are also generally not suitable for slicing or cubing other fruits and vegetables. The wedge shape created by current apple slicing devices is an undesirable shape for many uses. Consequently, current devices that are useful for slicing apples cannot be used for slicing and chopping onions or other food items.

SUMMARY OF THE INVENTION

A preferred example of the invention includes a slicer and a pusher, in which the slicer has a peripheral frame and internal cutting blades. The pusher is configured to be used to push at least partially sliced food items through the gaps between cutting blades.

In a preferred version of the invention, the device is configured to cut fruits into wedges and therefore the cutting blades are arranged in a radial fashion with substantially wedge-shaped gaps between blades.

In other versions of the invention, the blades may be arranged in a grid fashion, creating square, rectangular, or other shaped openings. In either case, for the sake of simplicity, the device will often be referred to as an apple wedger.

In some examples the pusher is hingedly attached to the slicer so that it can swing away from or toward the slicer in a pivotal fashion. When pivoted toward the slicer, raised projections on the pusher are urged into the openings between blades to push through any food items remaining in those openings

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
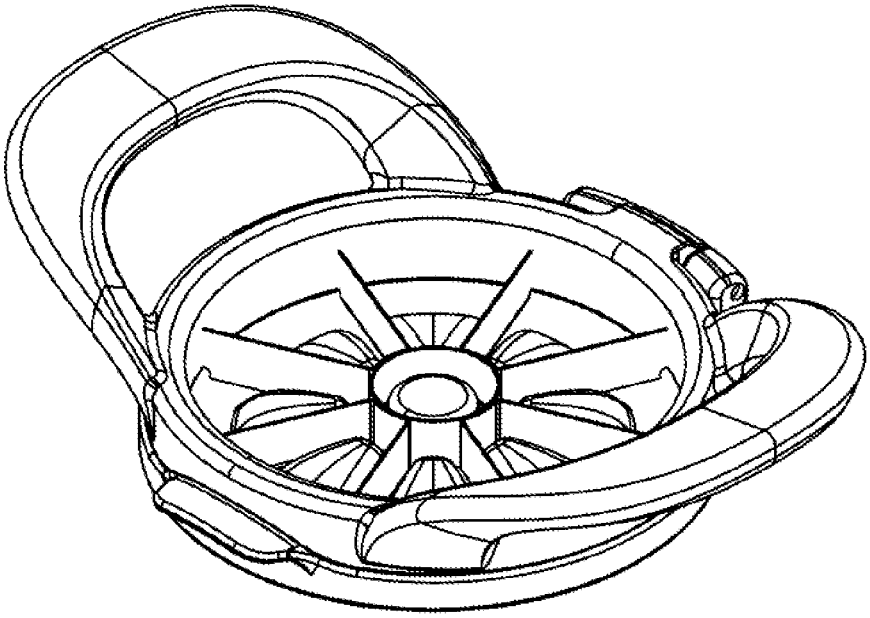
FIG. 1 is a perspective view of a preferred apple wedger, shown with a slicer and a pusher in a closed position.

A preferred version of the apple slicer and wedger, or general slicing device, is shown in the Figures as described below. FIGS. 1-6 generally illustrate a preferred version of the invention in the form of an apple wedger, while FIGS. 7-10 generally illustrate an alternate version of the invention configured with a grid of perpendicular blades.

As illustrated, the wedger includes a slicer 10 and a pusher 100 pivotally secured to the slicer. The slicer includes a peripheral frame 20 that is preferably formed in a ring or circular shape. In some alternate versions, the frame may be square or have a different shape other than circular. In a preferred example, the frame is rigid and formed from plastic, stainless steel, or other materials of sufficient strength to withstand the force imparted by urging the blades through an apple.

The blade portion of the slicer includes a central ring blade 30 and several radial blades 40 spanning the distance between the ring blade and the frame. Because the ring blade is located substantially at the center of the frame, each of the radial blades is substantially identical and divides the annular space between the frame and ring blade into equal wedge-shaped sections. In a preferred version the ring blade and radial blades are formed from stainless steel and welded or otherwise permanently secured to one another.

Figure 5:
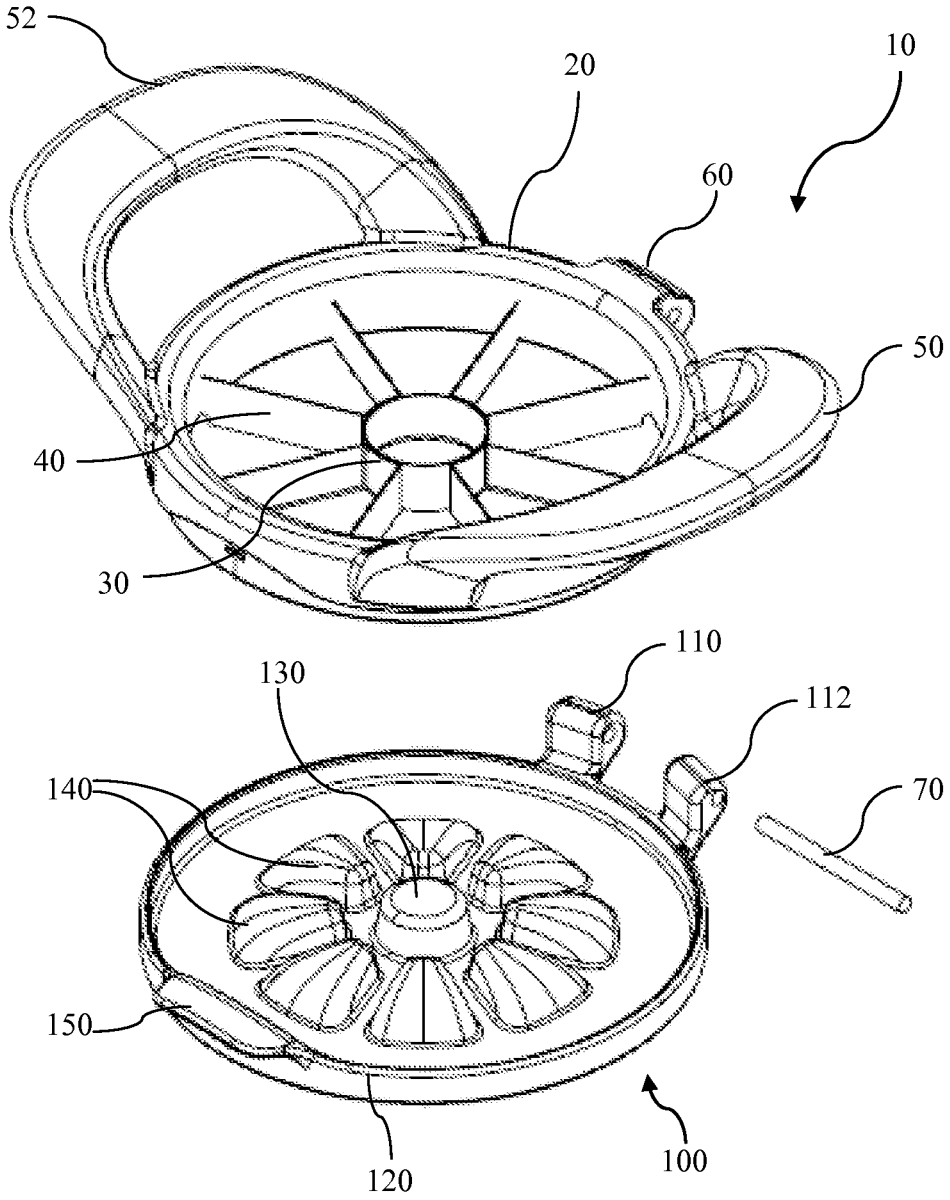
FIG. 5 is an exploded view of the apple wedger of FIG. 1.

As best seen in the top perspective view of FIG. 5, each of the blades 40 includes a sharpened lower edge 41. Likewise, the central ring blade includes a sharpened lower edge.

The frame may optionally include a pair of handles 50, 52 to aid in pushing the blades downward against an apple or other fruit. In the version as illustrated, the handles are diametrically opposite one another and oriented with distal ends that are raised above the plane of the blades and the rest of the frame, extending generally away from the sharpened edge of the blades. In other versions handles may be formed as a peripheral flange and need not be above the plane of the blades. Still further, in some versions the handle may include a soft grip which, for example, may be in the form of a resilient material over-molded onto a more rigid handle foundation.

The pusher 100 is configured for pivotal attachment to the slicer, preferably being attached at a hinge located along an edge of each of the pusher and slicer. Thus, in the preferred example the pusher and slicer each include complementary loops positioned and configured to receive a pin 70 that serves as an axis of rotation. As shown, the slicer 10 preferably includes a single loop 60 that is positioned between a pair of loops 110, 112 formed on the perimeter of the pusher. The loops are each configured with a central bore to receive the pin, thereby allowing the pusher and slicer to pivot about the pin with respect to one another. In alternate version of the invention, a variety of other configurations may be used to enable the pusher to pivot with respect to the slicer.

In the illustrated version, the hinge is formed at an upper end of the frame 20, and therefore the loops 110, 112 are positioned above the bottom of the pusher. In this configuration, the pin 70 forming the pivot axis is positioned at or above the top surface of the raised projections of the pusher. This positioning of the pivot axis allows a fuller rotation of the pusher before it contacts the food at the bottom of the slicer, thereby providing a more even force against the food rather than a force initially applied at the side adjacent the hinge.

In yet other versions, the pusher and slicer are not pivotally attached to one another, and in such versions the loops and pin are not used. The pivotal attachment is preferred, however, for ease of use and to retain the two components together for easy storage. Most preferably, each of the pusher and the slicer has a substantially circular perimeter, with the pusher and slicer being pivotally attached to one another at a location on the perimeter.

The pusher 100 is shaped with a perimeter that generally matches that of the slicer. Thus, most preferably the pusher is circular and includes an upwardly extending peripheral flange 120. In a version in which the perimeter of the blade is square or otherwise shaped, preferably the pusher has a corresponding perimeter. The frame 20 of the slicer 10 preferably is also formed with an outer sidewall that includes a complementary channel or other surface that is sized and configured to receive the flange when the pusher is pivoted to a position in which the pusher is closed snugly against the slicer. Thus, the outer perimeter of the slicer is seated just within the flange of the pusher when the two components are pivoted together.

Figure 6:
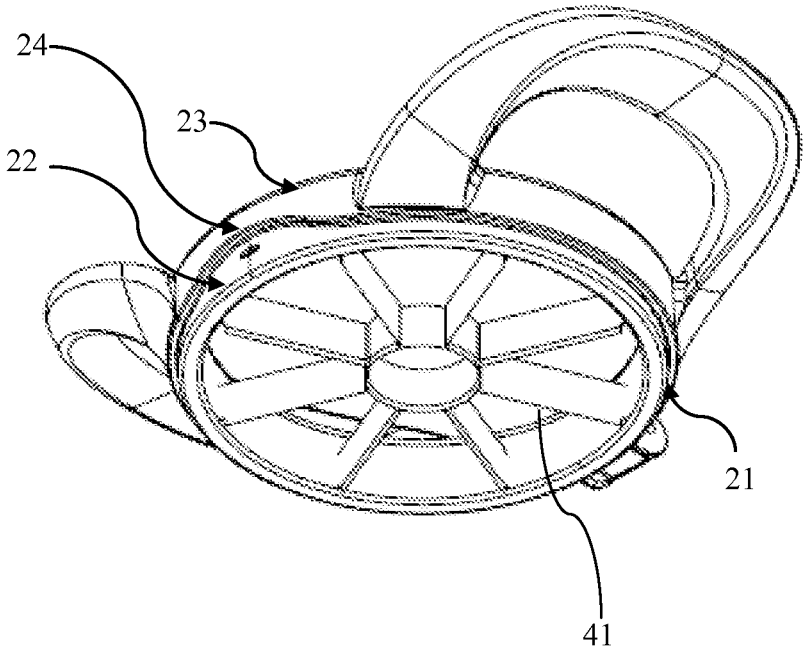
FIG. 6 is a bottom perspective view of the slicer portion of the apple wedger of FIG. 1.

In the version as illustrated in FIG. 6, rather than a complementary channel formed along a lower edge of the frame, the outer sidewall of the frame 20 includes an upper portion 23 and a lower portion 22, with the lower portion being recessed radially inward with respect to the upper portion. Accordingly, the diameter of the upper portion is somewhat larger than the lower portion, with a shoulder 21 defined at the transition between the upper and lower portions. The diameter of the outer surface of the lower portion of the frame is sized to snugly receive the inner surface of the peripheral flange 120 of the pusher when the pusher is pivotally rotated into a position closely adjacent the slicer.

The pusher further includes an interior floor portion that is generally planar, transitioning to several raised projections sized and positioned to fit in the spaces between the blades. The projections are raised in an upward direction that extends toward the slicer when the pusher is rotated into a closed position adjacent the slicer.

In the version as shown, there are eight radial blades 40 that define eight wedge-shaped spaces between the blades. Likewise, the pusher includes eight raised projections 140 that are positioned to fit between a respective one of the wedge-shaped spaces. In other versions, the device includes a greater or lesser number of blades and therefore a greater or lesser number of projections so that a projection is positioned between each pair of blades.

The projections 140 as shown in the preferred version have a height that is greatest adjacent the center of the pusher and somewhat rounded and tapered to a lower height toward the ends of the projections that are radially outward from the center. This greater height at the middle provides for a stronger pushing force at the center, where the greatest force may be required. In other versions, the height of the projections may be substantially the same across the entire top surface of the projection.

A central hub projection 130 is provided at the center of the pusher, positioned and shaped to fit within the ring blade 30. Thus, the hub projection is generally cylindrical in shape, though with slightly rounded corners to more readily fit within the ring blade and to provide for greater tolerance as the pusher rotates into contact with the slicer.

In the version as shown in FIGS. 1-6, the device is configured as an apple wedger that removes a core of an apple while slicing the remainder of the apple into wedge-shaped pieces. Accordingly, the pusher is configured with a central hub and eight wedge-shaped projections (when viewed from the top or bottom), each of the wedge-shaped projections being arranged circumferentially about the central hub.

In alternate versions, a greater or lesser number of wedge-shaped projections may be used. Likewise, the slicer and pusher may be formed without a central ring blade and corresponding hub, thereby forming a slicer that does not simultaneously separate the core from the fruit. In such a version, the blades 40 are simply joined substantially at the center of the slicer to form a plurality of wedges.

In yet other versions, the slicer includes a plurality of blades arranged perpendicularly to form a grid of squares which may be used to cut a potato into French fries or other such shapes, for example as illustrated in FIGS. 7-10. As still another version, the slicer may include a plurality of blades oriented parallel to one another to create slices, but without the orthogonal blades forming a grid as noted above, or with only a single blade perpendicular to the group of parallel blades in order to provide structural support. In the preferred implementation of each of the preferred versions the pusher includes projections sized and oriented to fit between the spaces separating the blades.

At a location diametrically opposite the hinge joining the pusher and slicer, the pusher includes a radial lip 150 sufficiently large to be engaged by a thumb or finger in order to separate the pusher from the slicer. The slicer and pusher may each further include a tongue and groove or other such complementary surfaces to retain the pusher against the slicer for storage (in the position as shown in FIG. 1), thereby requiring a small separation force to detach the tongue from the groove to rotate the pusher pivotally away from the slicer. The tongue and groove feature is provided on the inner face of the flange 120 and outer face of the sidewall of the frame 20, positioned at complementary locations.

In the version as shown in FIGS. 1-6, the shoulder between the upper and lower portions of the peripheral sidewall of the frame 20 includes an upwardly scalloped edge 24 to accommodate the tongue and groove feature. Likewise, the lip 150 is positioned at a raised location along the outer flange 120 of the pusher.

Figure 2:
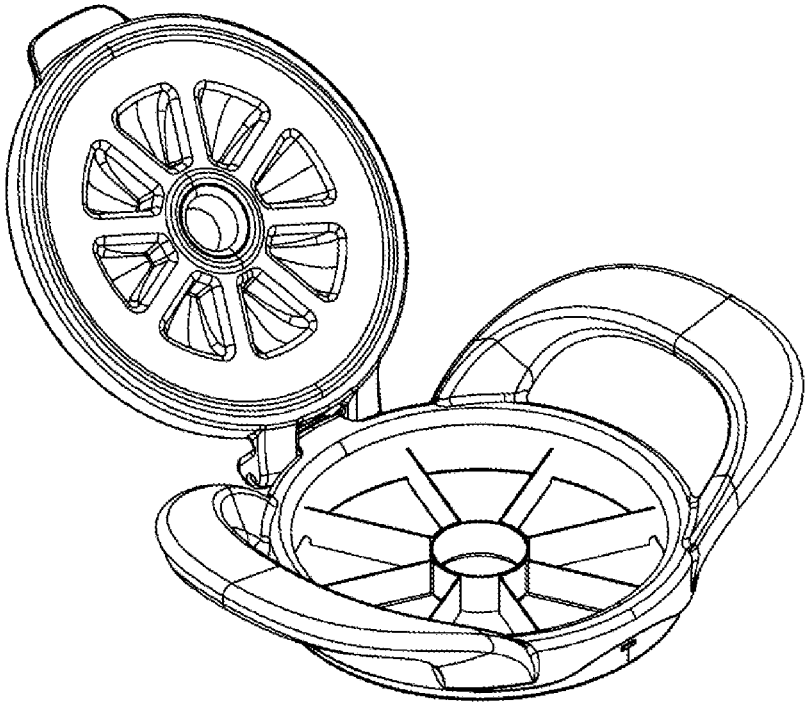
FIG. 2 is a perspective view of the apple wedger of FIG. 1, shown with the pusher in an open position.

In use, the slicer is placed against an apple or other food item. In the case of an apple, the slicer is preferably positioned such that the central ring blade is coaxial with an axis extending through the core of the apple from the stem to the blossom. The slicer is pushed downward against the apple, thereby separating the apple into wedges and forming a central cylinder segment that contains the majority of the core. In this initial operation of the slicer, the pusher is pivoted away from the slicer, preferably at an obtuse angle, so that it does not interfere with the slicing action. This orientation of the pusher with respect to the slicer is shown in FIG. 2, in which the pusher has been pivoted away from the slicer through an arc of more than 180 degrees with respect to its initial position as illustrated in FIG. 1. Most preferably, the pusher may be rotated about 225 degrees away from its resting or storage position in FIG. 1 in order to facilitate slicing. A suitable configuration, however, is one in which the pusher can simply be rotated away from the slicer sufficiently to allow the slicer to be pressed fully downward onto a horizontal surface while the pusher is rotated laterally away from the slicer. Such a rotation would be about 180 degrees, and perhaps slightly more or less depending on the position and configuration of the hinge. In the illustrated example, the hinges are positioned on the upper end of the frame and therefore a rotation of the pusher of less than 180 degrees will effectively move the pusher out of the area defined by an arc of 180 degrees with respect to the slicer. Thus, a rotation of "about" 180 degrees should be understood to include a somewhat smaller path of rotation as long as it allows the slicer to be pressed onto a horizontal surface with the pusher attached.

As noted above, the initial slicing is performed with the pusher rotated away from the slicer. Thus, the initial slicing is done by pressing the slicer downward against a food item and toward a countertop or cutting board while the pusher is rotated away.

Figure 3:
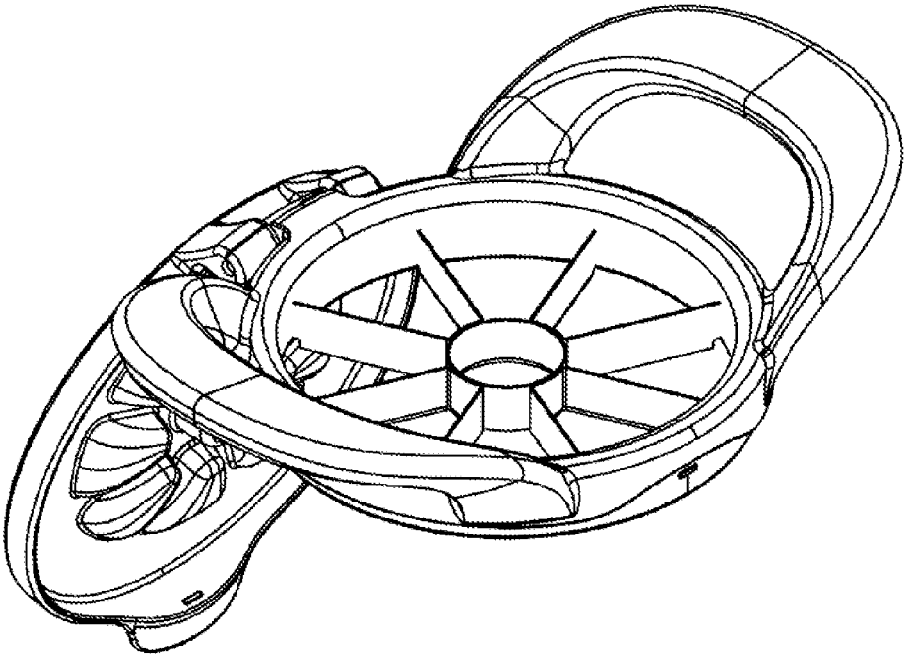
FIG. 3 is a perspective view of the apple wedger of FIG. 1, shown with the pusher in an intermediate position.
Figure 4:
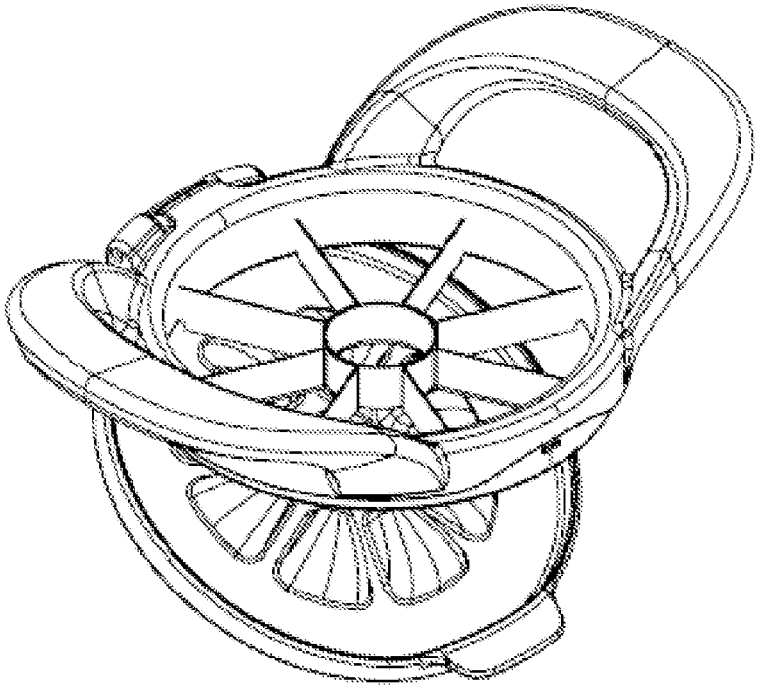
FIG. 4 is a perspective view of the apple wedger of FIG. 1, shown with the pusher in an intermediate position, nearly in the closed position.

At the termination of the slicing action, a portion of the meat and skin of the apple may not be fully sliced. In such a case, the pusher is rotated toward a closed position, adjacent the slicer. The path of rotation is shown in FIGS. 3 and 4, which illustrate intermediate positions of the pusher as it is progressively pivoted toward the slicer. As the pusher is rotated toward a fully closed position (as in FIG. 1), the raised projections of the pusher are urged into the spaces between the blades, thereby pushing any remaining bits of apple further through the spaces defined between the blades. Once the pusher is fully rotated to a closed position adjacent the slicer, the apple will be fully sliced by the blades and pushed into a position fully separated from the blades.

Figure 10:
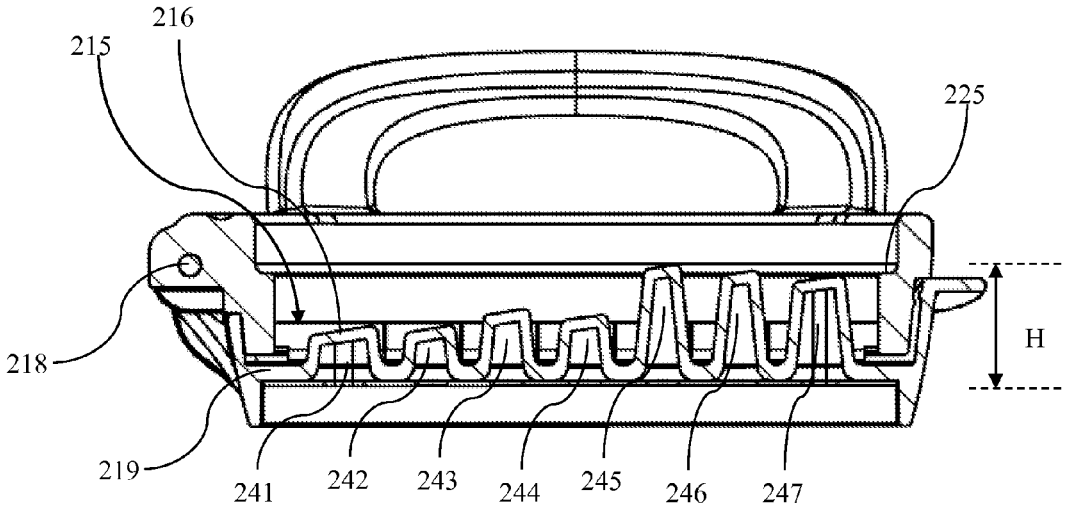
FIG. 10 is a sectional view of the slicing device of FIG. 7, taken along line A-A.
Figure 11:
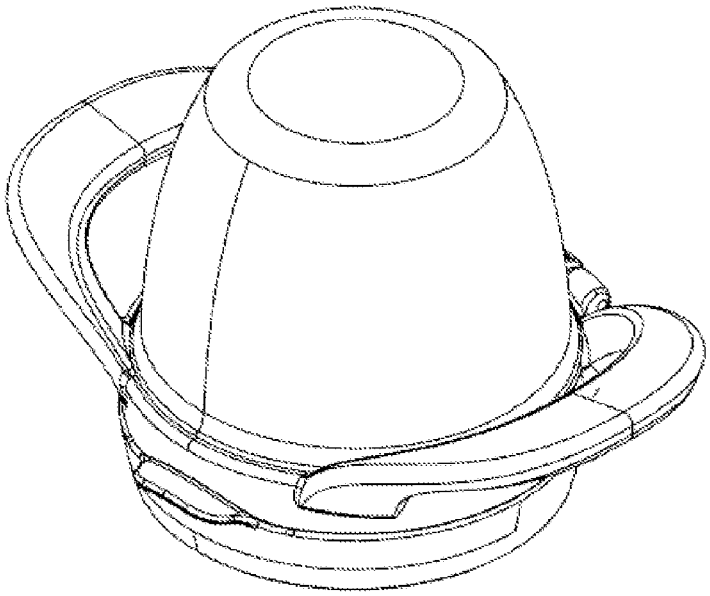
FIG. 11 is a perspective view of a preferred slicing device, shown with a storage container attached.
Figure 12:
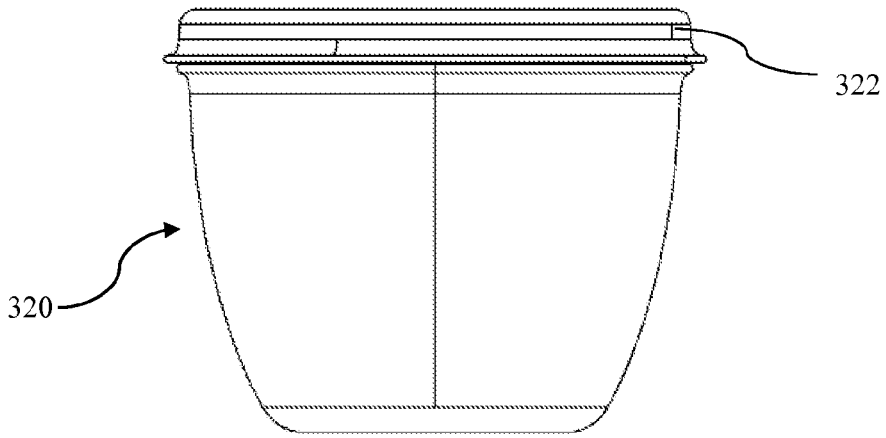
FIG. 12 is a side view of the storage container as illustrated in FIG. 11, shown with a lid attached.

In some versions, the slicer may include a receptacle attached to the slicer and positioned to receive sliced bits as they are pushed upward and through the blades, as illustrated in FIG. 11. Ideally, the receptacle is removably attached to the frame of the slicer, to allow the slices to be accessed readily after slicing. For example, the receptacle or container may include threads arranged around a rim of the container that mate with corresponding threads arranged around an inner portion of the peripheral frame 20. Alternatively, the threads may be omitted and instead the rim of the container may fit snugly within the inner portion of the peripheral frame. The container includes an upper rim configured to be received within the upper portion of the frame, and more particularly as illustrated in FIG. 10 the upper rim of the container may be frictionally secured to a seat 225 formed in the upper portion of the frame. This version is intended to be used in a fashion as described above, first pressing the slicer through the food item and against a cutting board or countertop, then swinging the pusher around to push the remaining bits through the blades. Sliced food pieces that are passed through the blades and captured in the container may then be retained within the container for storage. In one version, and additional lid 322 (see FIG. 12) may be secured to the rim of the container 320 for storage.

In a preferred version the invention the container 320 is transparent. Most preferably, the container also includes volumetric markings on at least one sidewall of the container to allow user to measure the volume of sliced food items retained within the container.

Figure 7:
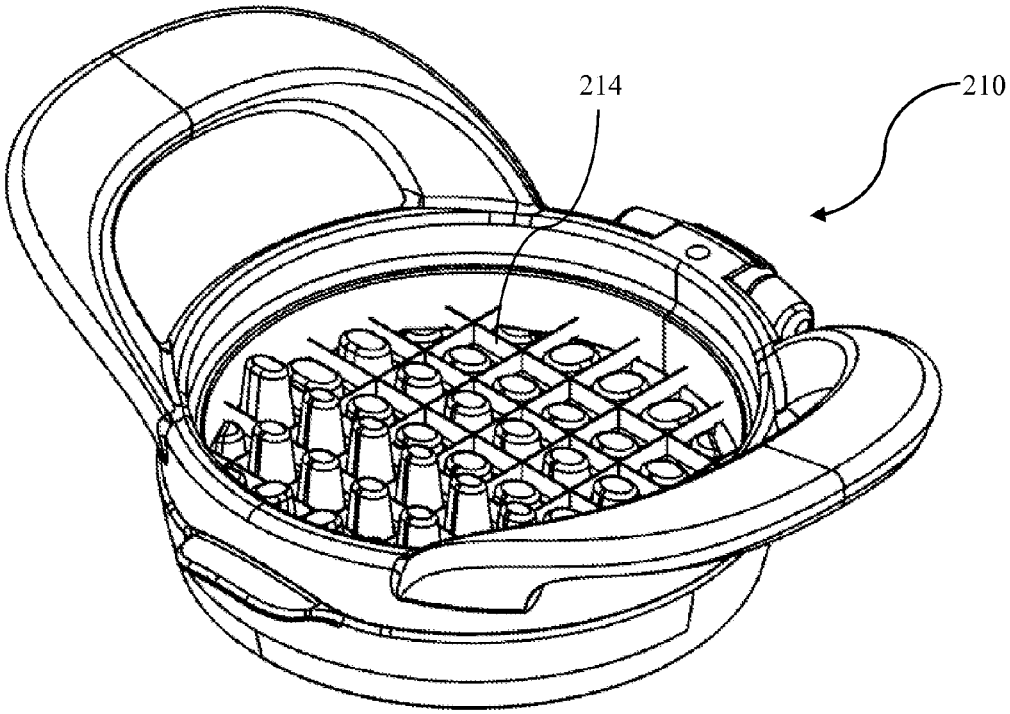
FIG. 7 is a perspective view of an alternate version of a preferred slicing device.

An exemplary version of an alternate embodiment of the invention incorporating a grid of perpendicular blades is illustrated in the perspective view of FIG. 7. The embodiment as shown in FIG. 7 is more generally a slicing device 210 rather than an apple wedger. With the grid of perpendicular blades, the slicing device is well-suited for chopping onions or slicing potatoes into french fries, for example.

Figure 8:
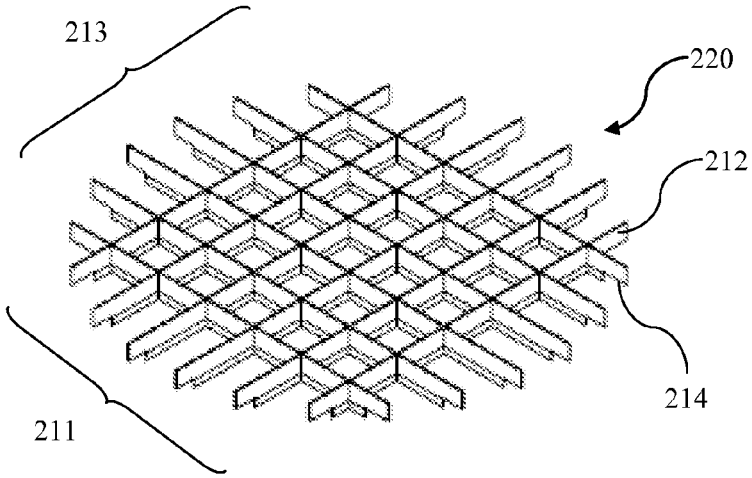
FIG. 8 is a perspective view of a grid of blades for use with the slicing device of FIG. 7.

In the version incorporating a grid of perpendicular blades, the grid 220 will include a plurality 211 of first blades (for example 212) arranged in parallel rows and a second plurality 213 of second blades (for example 214) arranged in parallel rows. As best seen in FIG. 8, the plurality of first blades is arranged to be perpendicular to the plurality of second blades. Thus, the grid of blades includes a plurality of blades that are perpendicular to one another thereby creating rectangular openings between sets of blades. In the particular version as illustrated, six blades are shown in a first direction and six additional blades in a perpendicular second direction. In other versions, any number of blades may be used.

Figure 9:
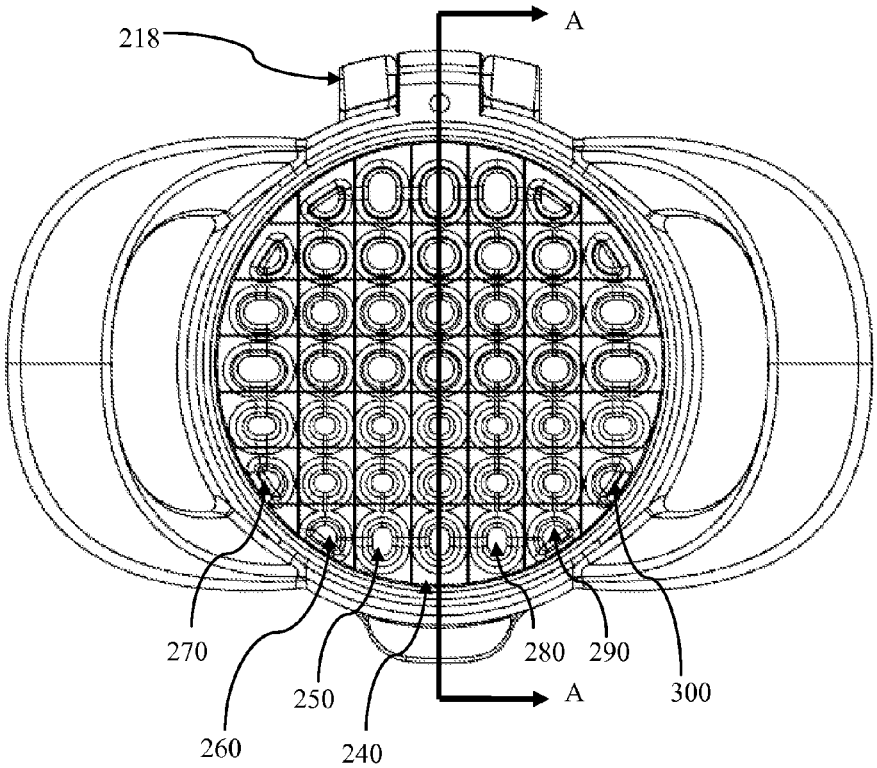
FIG. 9 is a top view of the slicing device of FIG. 7.

With reference to the top view of FIG. 9, the example slicing device includes a pusher having a plurality of projections as with the apple wedger, with each of the projections being sized and shaped to allow them to pass through one of the rectangular openings within the grid of blades. Accordingly, the projections formed on the pusher are arranged in columns and rows in a perpendicular fashion, as with the arrangement of the rectangular openings within the grid of blades. In the preferred example, the pusher includes six columns of projections 240, 250, 260, 270, 280, 290, 300. Each of these columns comprises several projections, with the plurality of projections being arranged in parallel rows.

In some versions of the invention each of the projections formed on the pusher may be of a similar or identical size and shape. Thus, in some examples of the invention each of the projections has the same height, with the height being indicated as a distance that the projection extends above a base 219 of the pusher in the vertical direction H as shown in FIG. 10. In other versions, as discussed further below, the height H above the base may be varied from one projection to the next.

Each of the projections includes an upper surface, for example surface 216 as indicated on a first projection 241. In some versions of the invention, the upper surfaces of the projections may be horizontal. By way of reference, horizontal is defined as the plane defined by the grid of blades. Thus, with reference to FIG. 10, the horizontal plane is indicated by reference number 215 pointing to an upper surface of the grid of blades. In the preferred version of the invention, the upper surfaces of the projections are each angled somewhat and preferably angled at about 10, 15, or 20° with respect to the horizontal plane 215. Most preferably, the orientation of the angled upper surface will include a taller end for the projection at a location farthest from the hinge or pivot point 218 and a shorter and for the projection at a location relatively closer to the pivot point 218.

In the preferred example of the invention, the height of the projections is also varied from one projection to the next. In versions of the invention in which all of the projections have the same height, it can be difficult to push the food items through the grid of blades. As illustrated in FIG. 10, the hinge 218 joining the pusher to the peripheral frame is offset in the vertical direction, raising the hinge toward the top of the peripheral frame and above the sharpened edges of the blades. While this configuration reduces stress on the hinge, it also causes all or nearly all of the projections to be pushed against the food item at substantially the same time when the projections are the same height. By altering the height of the projections, portions of the food item are pressed against the blade while other portions of the food item are not. This configuration more readily pushes the food items through the grid of blades by initiating slicing action against only some of the blades at a time.

With reference to the sectional view of FIG. 10, an example column of projections is shown. In this example, the first two projections 241, 242 most closely adjacent the hinge 218 are the shortest and are similar in height to one another. The third projection 243 is somewhat longer than the first two and, as illustrated, is approximately 20% longer. The fourth projection 244 has a height that is greater than the first two projections 241, 242 but less than the third projection 243. The fifth projection 245 is much taller than any of the first projections and as illustrated is approximately twice as tall as the fourth projection 244. The sixth projection 246 and seventh projection 247 are preferably each slightly shorter than the fifth projection, for example each one being about 10% shorter than the one before it.

Most preferably, the variations in height of the projections are arranged in groups. Thus, for example, in one version of the invention the projections in each of the columns may have heights that are arranged as with those of the central column 240. In other versions, a relatively central projection (for example 245) may be the tallest among all of the plurality of projections with neighboring projections in both columns and rows tapering off gradually in height in every direction toward the peripheral frame.

As illustrated in the preferred example, the tallest projection is approximately twice as tall as the shortest one. This ratio may be varied in other versions of the invention, for example, including versions in which the tallest projection is three times as tall as the shortest projection and versions in which the tallest projection is one and one half times as tall as the shortest projection.

Each of the various versions of invention as illustrated is suitable for slicing. In the context of this invention, the term "slicing" should be understood to include chopping or otherwise cutting, and is not intended to convey a particular arrangement of blades.

Figure 13:
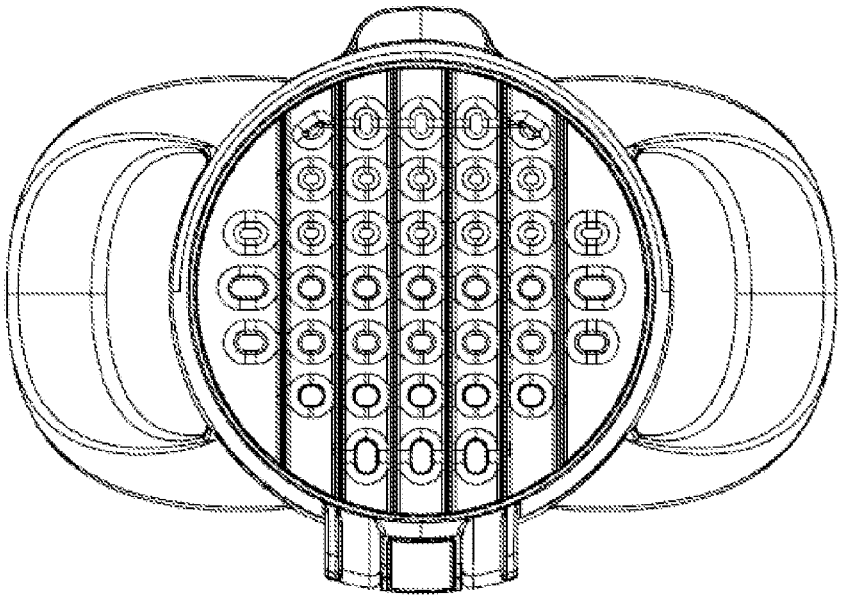
FIG. 13 is a top view of an alternate version of a slicing device.
Figure 14:
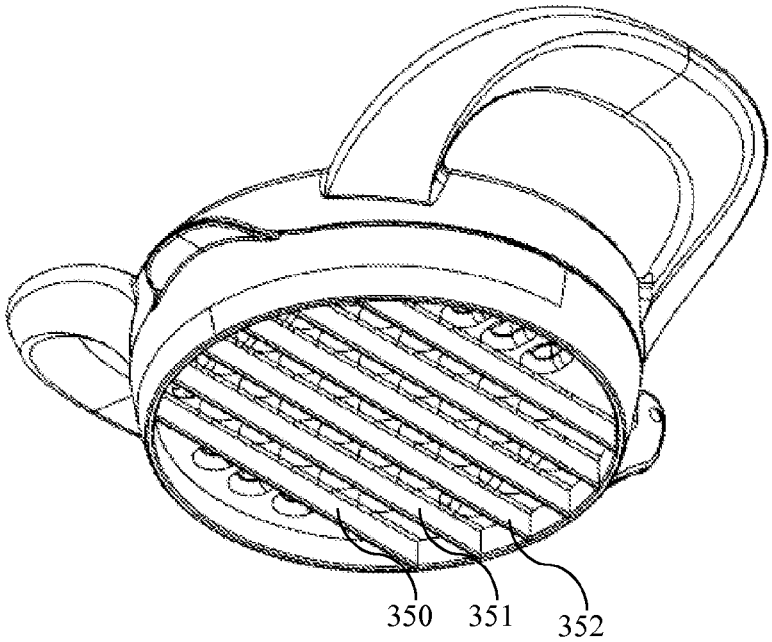
FIG. 14 is a bottom perspective view of the slicing device of FIG. 13.

In alternate version of the slicing device is shown in FIGS. 13 and 14. In this version, the device is substantially the same as the other versions except that the slicing blades are arranged in a single row of parallel blades, for example 350, 351, 352 rather than as two rows of parallel blades such as shown in FIG. 8. Each of these versions of the invention are referred to above as slicing devices, although the version of FIG. 7 may also be referred to as a chopping device because of its perpendicular rows of slicing blades.

Figure 15:
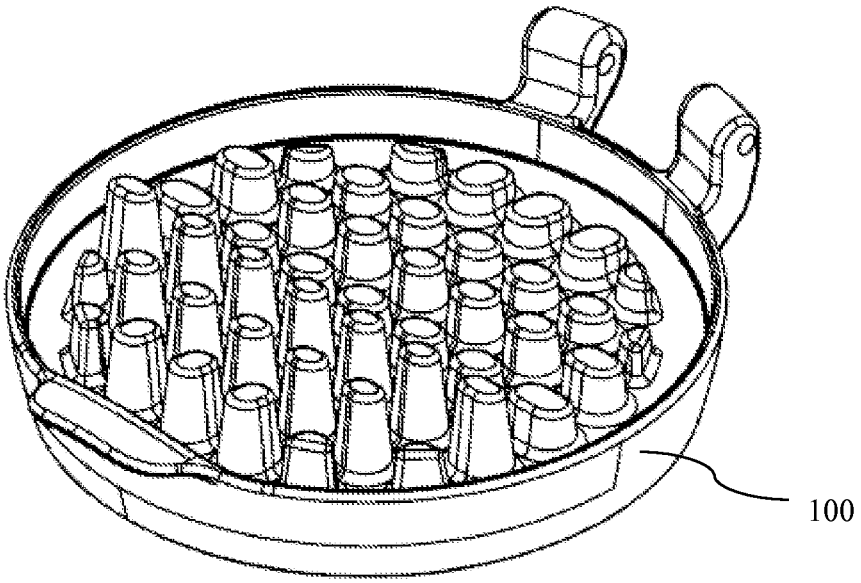
FIG. 15 is a top perspective view of an example pusher in accordance with a preferred version of the invention.

FIG. 15 shows a top perspective view of a preferred pusher in accordance with an exemplary version of the invention. In this illustration, the pusher is not connected to a slicing frame. As illustrated, the projections formed on the pusher are non-uniform in height, meaning that some of the projections are taller than others. Although the pusher as illustrated in the accompanying figures has always been shown to have a circular perimeter for use with a correspondingly similar slicing frame, other shapes may also be used. For example, the pusher having non-uniform projections may be incorporated into square or rectangular slicing and chopping blade configurations. Likewise, the orientation of the pusher with respect to the blades may be reversed, such that the pusher is used to press items through the blades in a downward fashion instead of the blades being used to push downward against the pusher. In either case, the non-uniform projection configuration can offer distinct advantages as described above.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A slicing device, comprising:

a peripheral frame defining an interior space;

a plurality of blades spanning the interior space, the plurality of blades defining a plurality of openings between the plurality of blades; and a pusher pivotally secured to the frame at a pivot location, the pusher having a plurality of projections extending upward from a pusher base;

the pusher being rotatable with respect to the frame between a first position in which the pusher is adjacent the frame and the plurality of projections are extending into the plurality of blades, and a second position in which the pusher is rotated away from the frame;

each of the plurality of projections further having a height above the base, the height of at least a first subset of the plurality of projections being greater than the height of a second subset of the plurality of projections, wherein the plurality of projections comprise a tallest projection and a shortest projection, the tallest projection being at least 1.5 times taller than the shortest projection;

each of the plurality of projections further having an upper surface, each of the upper surfaces being taller above the pusher base at a location distant from the pivot location and shorter above the pusher base at a location closest to the pivot location, whereby the upper surfaces are angled downward toward the pivot location; and a pair of handles mounted on the frame, each of the pair of handles being positioned diametrically opposite the other.

2. The slicing device of claim 1, wherein the plurality of projections are arranged in a plurality of columns, each of the plurality of columns having a first end and a second end.

3. The slicing device of claim 2, wherein the plurality of projections within at least one of the plurality of columns form a plurality of heights.

4. The slicing device of claim 1, wherein each of the upper surfaces are angled with respect to a horizontal plane defined by the pusher base, the upper surfaces forming an angle of greater than 10 degrees with respect to the plane.

5. The slicing device of claim 1, wherein the tallest projection is at least 2 times taller than the shortest projection.

6. The slicing device of claim 1, wherein the frame has a top end and a bottom end, the pusher being pivotally secured to the frame at a hinge, wherein the hinge is positioned at the top end of the frame.

7. The slicing device of claim 6, wherein the pusher is pivotable about an angle of greater than or equal to 180 degrees.

8. The slicing device of claim 1, further comprising a container removably attached to the frame, the container being positioned to receive food items pushed through the grid of blades by the projections.

9. A slicing device, comprising:

a peripheral frame defining an interior space;

a plurality of blades spanning the interior space, the plurality of blades defining a plurality of openings between the plurality of blades; and a pusher pivotally secured to the frame at a pivot location, the pusher having a plurality of projections extending upward from a pusher base;

the pusher being rotatable with respect to the frame between a first position in which the pusher is adjacent the frame and the plurality of projections are extending into the plurality of blades, and a second position in which the pusher is rotated away from the frame;

the plurality of projections being arranged of rows and columns including a first row adjacent the pivot location and a plurality of additional rows distant from the pivot location, and further defining a plurality of perimeter projections and a plurality of interior projections, wherein at least one of the interior projections is taller than each of the projections in the first row.

10. The slicing device of claim 9, wherein each of the projections in the first row adjacent the pivot location is shorter than each of the projections in the plurality of additional rows.

* * * * *